US009212620B2

(12) United States Patent
Berkemeier et al.

(10) Patent No.: US 9,212,620 B2
(45) Date of Patent: Dec. 15, 2015

(54) COOLANT JACKETS FOR AN INTERNAL COMBUSTION ENGINE AND METHOD OF CONTROL

(75) Inventors: Oliver Berkemeier, Bergisch Gladbach (DE); Kai Sebastian Kuhlbach, Bergisch Gladbach (DE); Martin Lutz, Koeln Nordrheinwestfalen (DE); Jan Mehring, Cologne (DE); Richard Fritsche, Wermelskirchen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 223 days.

(21) Appl. No.: 13/020,741

(22) Filed: Feb. 3, 2011

(65) Prior Publication Data

US 2011/0197832 A1 Aug. 18, 2011

(30) Foreign Application Priority Data

Feb. 18, 2010 (DE) ..... 10 2010 002 082

(51) Int. Cl.
*F02F 1/24* (2006.01)
*F01P 3/02* (2006.01)

(52) U.S. Cl.
CPC ..... *F02F 1/243* (2013.01); *F01P 2003/028* (2013.01); *F01P 2037/02* (2013.01); *F01P 2060/08* (2013.01)

(58) Field of Classification Search
CPC . F02F 1/243; F01P 2003/028; F01P 2037/02; F01P 2060/08
USPC ..... 123/41.09, 41.44, 41.74
See application file for complete search history.

(56) References Cited

U.S. PATENT DOCUMENTS

| | | | | |
|---|---|---|---|---|
| 4,601,265 | A * | 7/1986 | Wells et al. | 123/41.28 |
| 2006/0213460 | A1 | 9/2006 | Aoki et al. | |
| 2008/0168956 | A1* | 7/2008 | Lutz et al. | 123/41.1 |
| 2010/0007095 | A1* | 1/2010 | Klinner | 277/592 |

FOREIGN PATENT DOCUMENTS

| | | | |
|---|---|---|---|
| DE | 102006008270 | A1 | 8/2007 |
| EP | 0038556 | A1 | 10/1981 |
| EP | 1900919 | A1 | 3/2008 |
| EP | 1947308 | A1 | 7/2008 |

OTHER PUBLICATIONS

ISA German Patent and Trademark Office, Search Report of DE10 2010 002 082.6-13, Oct. 19, 2010, Germany, 4 pages.

* cited by examiner

*Primary Examiner* — Lindsay Low
*Assistant Examiner* — Jacob Amick
(74) *Attorney, Agent, or Firm* — Julia Voutyras; Alleman Hall McCoy Russell & Tuttle LLP

(57) ABSTRACT

An internal combustion engine is provided. The internal combustion engine includes a cylinder block having a cooling jacket and a cylinder head having two cooling jackets. In one example, the internal combustion engine may be operated so as to reduce engine friction and emissions during cold engine starts.

17 Claims, 5 Drawing Sheets

COOLANT JACKETS FOR AN INTERNAL COMBUSTION ENGINE AND METHOD OF CONTROL

RELATED APPLICATIONS

This application claims priority to German Patent Application No. DE102010002082.6, filed on Feb. 18, 2010, the entire contents of which being incorporated herein by reference.

BACKGROUND/SUMMARY

Coolant jackets may be provided in both cylinder heads and cylinder blocks of internal combustion engine to provide cooling to the engine. EP 0 038 556 B1, for example, describes a cooling system for an internal combustion engine. Coolant is conveyed through a cylinder head coolant jacket via a first pump. A second pump conveys coolant through the cylinder block coolant jacket. The cylinder head coolant jacket and the cylinder block coolant jacket are not connected within the internal combustion engine. However, the outlets of the cylinder block and cylinder head coolant jackets are connected in a main coolant circuit line. A cooler bypass line system branches off from the main coolant circuit line. The cooler bypass line is connected to an inlet of both the cylinder head coolant jacket and the cylinder block coolant jacket. A control valve may prevent coolant flow to a cooler positioned in the main coolant circuit line and permit flow through the cooler bypass line system. A second control valve may be used to interrupt or adjust a coolant flow through the cylinder block coolant jacket.

To provide a more integrated design, in some internal combustion engines the cylinder block and the cylinder head may be traversed in each case separately from one another by coolant in their respective coolant circuits. In other words, the coolant may flow through the engine in a parallel configuration such that one coolant circuit flows though the cylinder head and another coolant circuit flows through the cylinder block. This cooling arrangement may be referred to as a split cooling system. In this way, the cylinder head, which is thermally coupled to a combustion chamber wall and the exhaust-gas conducting arrangement, and the cylinder block, which is thermally coupled to friction components as well as other components, can be separately cooled. The aim of split cooling system is to provide cooling to the cylinder head in the warm-up phase of the internal combustion engine and prevent cooling to the cylinder block in the warm-up phase. As a result, the cylinder block can be brought up to a desired operating temperature more quickly. Preventing coolant flow to the cylinder block may be referred to as a no flow strategy.

EP 1 900 919 A1 discloses an engine with this type of split cooling system. Specifically EP 1 900 919 A1 discloses a split coolant circuit in an internal combustion engine in which a cylinder head coolant jacket and a cylinder block coolant jacket are provided. The split coolant circuit includes a pump, a cooler, a thermostat and a heating arrangement (e.g., heat exchanger). The split coolant circuit may be configured to circulate coolant therethrough. The thermostat is arranged so as to control the flow of the coolant both through the cylinder block coolant jacket and through the cooler when the coolant exceeds a predefined temperature. The split cooling design enables the engine oil, the engine coolant, and/or the cylinder liners of the pistons to be heated more quickly. As a result, engine friction and emissions during cold starting conditions may be decreased.

The Inventors herein have recognized several drawbacks to this type of split coolant circuit. For example, if a vehicle occupant were to request cabin heating during the engine warm-up phase, engine coolant may be directed through the cylinder block and to the heater core thereby increasing engine warm-up time. Accordingly, engine emissions and fuel consumption may be increased during such conditions.

As such in one approach, an internal combustion engine is provided. The internal combustion engine includes a cylinder block including a cylinder block coolant jacket and a cylinder head including an outlet-side cylinder head coolant jacket having an exhaust-gas collector integrated therein, the cylinder head coupled to the cylinder block to form at least one combustion chamber and the outlet-side cylinder head coolant jacket including at least one coolant passage adjacent to the exhaust-gas collector. The internal combustion engine further includes a coolant pump fluidly coupled to the cylinder block coolant jacket and the outlet-side cylinder head coolant circuit and a control system configured to, during a portion of a warm-up phase, flow coolant through an outlet-side cylinder head coolant jacket and inhibit coolant flow through the cylinder block coolant jacket. In this way, coolant flow may be inhibited to the cylinder block during certain warm-up enabling the engine block to reach a desired operating temperature more quickly.

Further in some examples, the outlet-side cylinder head coolant jacket is fluidly coupled to a cabin heating arrangement and the control system is further configured to, during a portion of a warm-up phase, flow coolant from the outlet-side cylinder head coolant jacket to the cabin heating arrangement. In this way, heat may be provided to a cabin of the vehicle during warm-up while at the same time enabling the cylinder block to reach a desired operating temperature more quickly by substantially inhibiting flow of coolant into the cylinder block coolant jacket.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
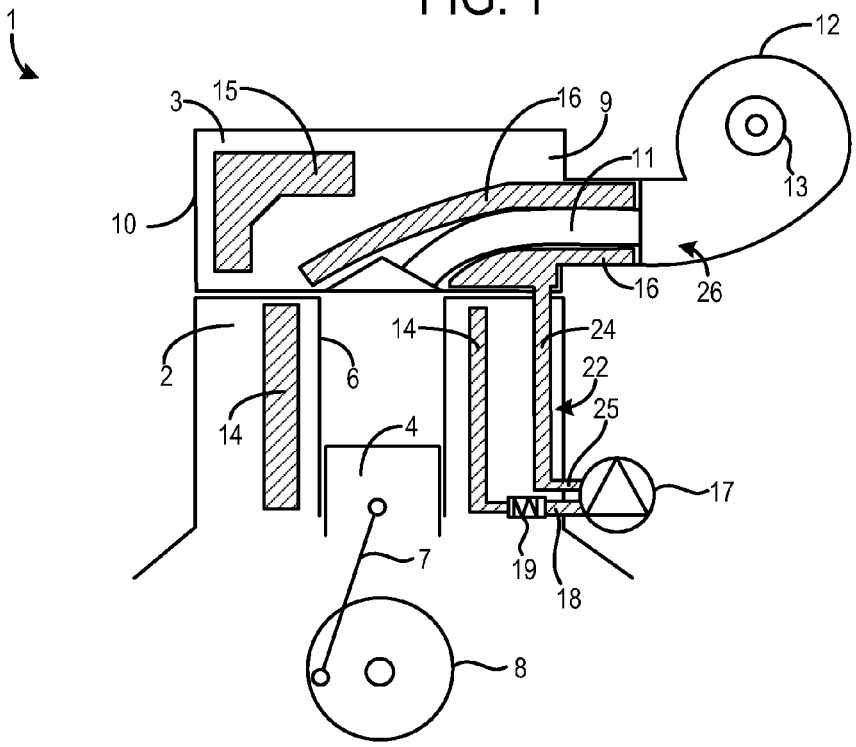
FIG. 1 shows a diagrammatic sketch of an internal combustion engine having a cylinder block coolant jacket and an outlet-side cylinder head coolant jacket.

A cooling strategy for an internal combustion engine is disclosed herein. The cooling strategy may include separately adjusting coolant flow to a cylinder block and a cylinder head to enable the cylinder block to reach a desired operating temperature more quickly. At the same time, cooling is provided to an exhaust-gas collector that may be integrated into the cylinder head. As a result, the engine friction and emissions during an engine cold start may be reduced. Furthermore, heat from the exhaust-gas collector may also be transferred to a cabin heating arrangement to provide a vehicle operator with enhanced comfort and/or enable defrost operation within the cabin. In FIGS. 1-4 described below, the same parts are always provided with the same reference numerals, such that said parts are generally also described only once.

FIG. 1 shows an internal combustion engine 1 having a cylinder block 2 and a cylinder head 3. Internal combustion engine 1 may further include at least one piston 4 is arranged in the cylinder block 2. The piston 4 may be positioned within a cylinder liner 6. The piston is connected via a connecting rod 7 to a crankshaft 8. In this way, piston motion caused via combustion may be used to drive the crankshaft.

The cylinder head 3 may be divided into an outlet side 9 and an inlet side 10, as shown in FIG. 1. The inlet side may be positioned adjacent to an intake system and the outlet side may be positioned adjacent to an exhaust system. One or more intake valves may be mechanically coupled to or integrated with the inlet side 9 in some examples. Likewise, one or more exhaust valves may be mechanically coupled to or integrated with the outlet side 10 in some examples. An exhaust-gas collector 11 may be integrated in the cylinder head 3. In other words, the cylinder head and the exhaust-gas collector may be formed in one piece with the latter. However, in other examples, the exhaust-gas collector 11 may be arranged external to the cylinder head 3. The exhaust-gas collector may be in the form of an exhaust manifold. The exhaust-gas collector 11 may be configured to merge exhaust gases from a plurality of combustion chambers in the internal combustion engine 1 into a common exhaust line fluidly coupled to the exhaust system. In this way, exhaust gases may flow through the exhaust-gas collector into the exhaust system.

An exhaust-gas turbocharger may be arranged in the exhaust system. The exhaust-gas turbocharger may include a turbine 13 having a housing 12 enclosing various components included in the turbine such as a rotor assembly. It will be appreciated that the exhaust-gas turbocharger may further include a compressor coupled to the turbine 13 and positioned in the intake system. Additionally, the exhaust system may include various exhaust-gas after-treatment devices (not shown), such as catalysts, filters, etc., coupled to an exhaust conduit. It will be appreciated that when the exhaust gases from the exhaust-gas collector are delivered to a single exhaust conduit including an after-treatment device, the after-treatment device may be brought up to a desired operating temperature more quickly when compared to other internal combustion engines which may include multiple after-treatment devices each positioned in a separate exhaust conduits.

The internal combustion engine 1 may also include a cylinder block coolant jacket 14 and an inlet-side cylinder head coolant jacket 15 both of which are indicated in FIG. 1. The internal combustion engine may also include an outlet-side cylinder head coolant jacket 26 that is integrated with the exhaust gas collector 11. The outlet-side cylinder head coolant jacket may include one or more coolant passages 16 traversing the cylinder head adjacent to the exhaust-gas collector 11, as illustrated in FIG. 1. It will be appreciated that FIG. 1 show cross-sectional views of the internal combustion engine. Therefore, the illustrated coolant jackets, passages, etc., may be coupled via additional passages extending into and out of the page. Additionally, the inlet-side cylinder head coolant jacket 15 may include at least one coolant passage adjacent to an intake manifold in the internal combustion engine and provide cooling for a plurality of cylinders.

Figure 2:
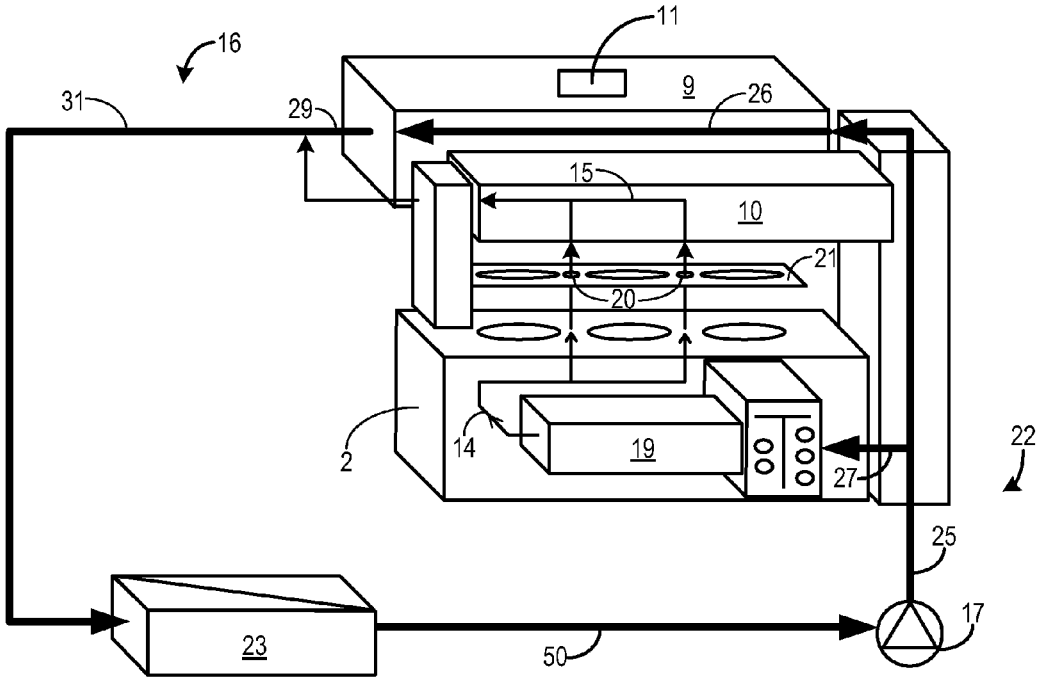
FIG. 2 shows another diagrammatic sketch of the internal combustion engine shown in FIG. 1.

It will be appreciated that coolant flow in the cylinder block coolant jacket 14 and the outlet-side cylinder head coolant jacket 26 may be separated. Specifically as shown in FIG. 2, the cylinder block coolant jacket 14 and outlet-side cylinder head coolant jacket 26 may be fluidly coupled the coolant pump 17 and to line 29. However, fluid may not flow between the cylinder block coolant jacket and the outlet-side cylinder head coolant jacket at intermediary locations between the pump 17 and line 29. In this way, coolant may flow in a parallel type flow path. Coolant flow in the internal combustion engine is discussed in greater detail herein with regard to FIG. 4.

The cylinder block coolant jacket 14 may be connected for example to the inlet-side cylinder head coolant jacket 15 via bores 20 cylinder head seal 21, as shown in FIG. 2. In some examples, coolant vapors which may form in the cylinder block coolant jacket may be discharged to the inlet-side cylinder head coolant jacket 15 via the bores 20. It will be appreciated that the coolant vapors may be discharged via the connection of the cylinder block coolant jacket 14 to the inlet-side cylinder head coolant jacket 15 when flow to the cylinder block coolant jacket is inhibited. In this way, coolant flow may be substantially inhibited in the cylinder block coolant jacket 14 for an extended time period while decreasing the likelihood of thermal degradation to the cylinder block that may be caused by coolant vapors.

The cylinder block coolant jacket 14 is fluidly connected to a coolant pump 17, as shown in FIGS. 1 and 2. A thermostat in the form of a cylinder block thermostat 19 is arranged in a corresponding connecting line 18 fluidly coupling the coolant pump 17 to the cylinder block coolant jacket 14. In this way, the thermostat 19 is arranged between the coolant pump outlet and the cylinder block coolant jacket inlet so as to isolate the cylinder block coolant jacket and the inlet-side cylinder head coolant jacket from the inlet side of the outlet-side cylinder head coolant circuit. In some examples, the thermostat 19 may be integrated into the cylinder block 2. The thermostat 19 may include a temperature sensor, a controller, and an adjustable valve. Further, the cylinder block coolant jacket 14 is connected for example to the inlet-side cylinder head coolant jacket 15 (bores or gas venting bores in the cylinder head seal 21), as shown in FIG. 2.

The thermostat 19, shown in FIGS. 1 and 2, may be configured to adjust the coolant flow to the cylinder block coolant jacket 14 based on the temperature of the coolant. The thermostat may be included in a control system. The control system may further include the pump 17 as well as other components. Various control strategies may be used to adjust the flow of coolant into the cylinder block coolant jacket. Specifically, in a warm-up phase of the internal combustion engine 1, that is to say for example after a cold start of the latter, the thermostat 19 may be configured to close, thereby substantially inhibiting coolant flow into the cylinder block coolant jacket 14 from the coolant pump 17. Specifically, in some examples, coolant flow to the cylinder block coolant jacket 14 until the coolant temperature at the thermostat 19 reaches and/or surpassed a threshold temperature which may be predetermined. A cold start may be an engine start-up that is implemented when the engine is below a threshold temperature. In some examples, the threshold temperature may correspond to the ambient temperature. However, in other examples other threshold temperatures may be used. It will be appreciated that a negligible amount of coolant may travel through the thermostat when coolant flow is substantially inhibited, due to characteristics of the thermostat valve.

Further in some examples, during a portion of an engine warm-up phase coolant may be directed to a cabin heating arrangement 23 from the exhaust-gas collector cooling circuit 16, which, at least in the warm-up phase of the engine is separate from the coolant circuit of the engine. In this way, heat may be provided to a cabin of the vehicle while substantially inhibiting coolant flow to the cylinder block coolant jacket, enabling the cylinder block 2 to reach a desired operating temperature more quickly during engine warm-up when compared to other engine designs which may direct coolant into the cylinder block coolant jacket during warm-up. In addition, the exhaust-gas collector cooling circuit 16 may be permanently traversed by coolant flow, even during the engine warm-up phase so that the cabin heating arrangement 23 can be operated by means of a supply of heat from the exhaust gases without interrupting the no-flow strategy of the cylinder block coolant jackets 14. Thus, a heat may be provided to the cabin to enable window defrost and/or to enhance the vehicle operator's comfort during start-up while at the same time reducing the likelihood of increased engine wear caused by insufficient engine lubrication.

Advantageously provided for this purpose is the exhaust-gas collector cooling circuit 16 which, at least in the warm-up phase of the internal combustion engine 1, is separate from the coolant circuit of the internal combustion engine 1. Said exhaust-gas collector cooling circuit 16 is connected to the coolant pump 17 via a bypass 22. The bypass 22 may be configured to flow coolant around the cylinder block coolant jacket 14. A further part of the exhaust-gas collector cooling circuit 16, in particular to and from a cabin heating arrangement 23, is illustrated in FIG. 2. The bypass 22 may be formed in the internal combustion engine and extend from the coolant pump 17 both through the cylinder block and through the cylinder head in the direction of the coolant jacket of the exhaust-gas collector. In this respect, the bypass may advantageously be formed either as a duct which is cast into the components or as a drilled duct, that is to say as a coolant duct.

In some examples, the bypass may be integrated in the cylinder block as a coolant duct. That is to say between the coolant pump and the cylinder head. In another example, the bypass, or the corresponding coolant ducts may be guided in the front cover, in the cylinder block, through the cylinder head seal and into the outlet-side of the cylinder head, with the exhaust-gas collector being integrated in the cylinder head at the outlet-side 9. Still further in some examples the bypass 22 may be formed outside the internal combustion engine 1 as an external line which is connected to the outlet-side cylinder head coolant jacket 26. Additionally in some examples a second pump may be provided which generates the coolant flow through outlet-side cylinder head coolant jacket to the cabin heating arrangement and back to the second pump. The second pump may be configured to adjust the outlet flow of the second pump during a warm-up phase. Furthermore, the second pump may also be configured to assist the coolant pump 17.

In this way, the engine includes a cylinder head having first and second cooling circuits, the first cooling circuit isolated from the second cooling circuit at least between an inlet and an outlet of the first cooling circuit, the first cooling circuit in fluidic communication with the cylinder block coolant jacket; and a coolant pump in fluidic communication with the cylinder block coolant jacket and the second cooling circuit. As such, coolant can flow through the second coolant circuit (e.g., the cylinder head outlet-side coolant circuit) while coolant in the first coolant circuit (e.g., the cylinder head inlet-side coolant circuit) remains in the cylinder head.

In the exemplary example illustrated in FIG. 1, the bypass 22 is fluidly connected to the coolant pump 17 via a connecting section 25. The connecting section 25 leads to a duct 24. The duct 24 may traverse a portion of the cylinder block 2 and pass through the cylinder head seal 21. The duct 24 may also traverse a portion of the cylinder head 3 and be fluidly coupled to the exhaust-side cylinder head coolant jacket 26 and in some cases to coolant passages 16. The duct 24 may be cast or drilled into the aforementioned components (i.e., the cylinder head 3 and the cylinder block 2). For example, the coolant pump 17 has two outlets, of which one is connected to the connecting section 25 and the other is connected to the thermostat 19.

FIG. 2 shows another example of the internal combustion engine 1, illustrating a general flow of coolant through the engine to further enhance engine warm-up and cabin heating. It will be appreciated that the coolant flow may have additional complexity, discussed in greater detail herein with regard to FIG. 4. FIG. 2 includes many of the components shown in FIG. 1, therefore similar components are labeled accordingly.

The connecting section 25 fluidly couples the coolant pump 17 to various coolant passages included in the internal combustion engine. Specifically, the connecting section 25 is coupled to the duct 24. A connecting duct 27 may branches off from said connecting section 25. The connecting duct 27 may be fluidly coupled to the cylinder block thermostat 19. In this respect, the exemplary example of the engine 1 shown in FIG. 2 differs from the example of the engine 1 shown FIG. 1, which has two pump outlets.

Figure 3:
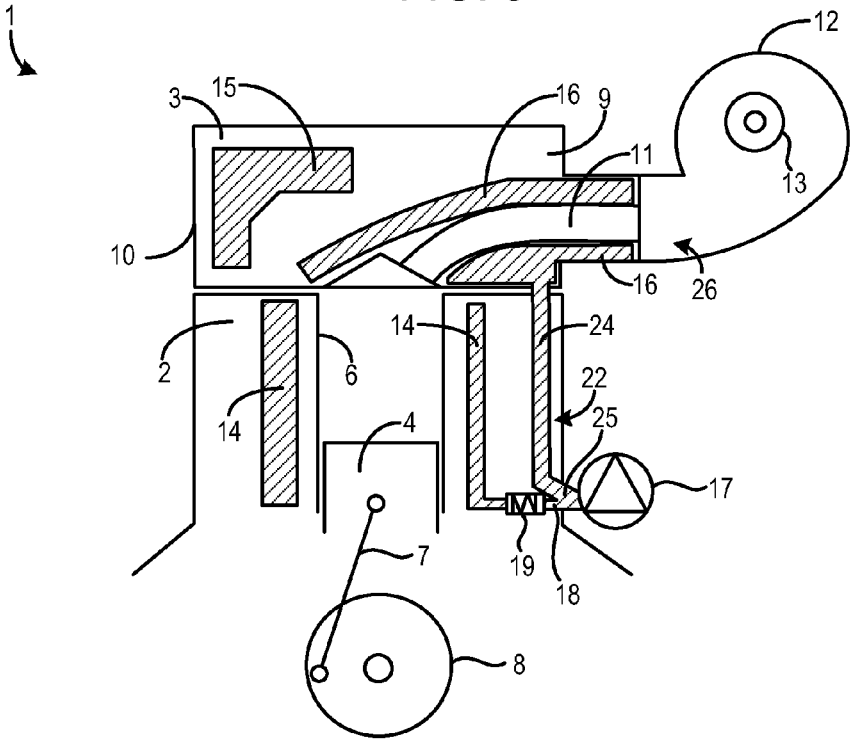
FIG. 3 shows another example of the internal combustion engine shown in FIG. 1.

FIG. 3 shows a cross-sectional view of the example of the engine 1 shown in FIG. 2. When the thermostat 19 is open coolant flow may separate at the junction between the connecting section 25 and the connecting duct 27. An open thermostat may include a thermostat that is in a configuration which permits coolant flow therethrough and a closed thermostat may include a thermostat that is in a configuration which substantially inhibits coolant flow therethrough.

On the other hand, when the thermostat 19 is closed coolant still flows upward, bypassing the cylinder block coolant jacket 14, through the bypass 22 into the cylinder head 3 on the outlet side 9 of the exhaust manifold 11 integrated in the cylinder head 3. It will be appreciated that the configuration of the thermostat may be altered based on the temperature of the coolant. Therefore, it is possible for the cooling circuits which are initially separate in the warm-up phase to be connected to one another after the end of the warm-up phase.

The duct 24 may traverse a portion of the cylinder head 3 and/or to the exhaust-gas collector 11 integrated therein. The cylinder block coolant jacket 14 may be connected to the inlet-side cylinder head coolant jacket 15 via bores 20 in the cylinder head seal 21. It will be appreciated that the inlet-side cylinder head coolant jacket 15 may be positioned vertically above the cylinder block coolant jacket. Thus, the bores 20 may enable coolant vapor to travel from the cylinder block coolant jacket 14 to inlet-side cylinder head coolant jacket 15. Specifically, vapor may travel through the bores when coolant flow to the cylinder block coolant jacket 14 from the coolant pump 17 is substantially inhibited.

In the warm-up phase of the internal combustion engine 1, the cylinder block thermostat 19 may be closed. Closing the thermostat to substantially inhibit coolant flow in the cylinder block coolant jacket 14 may be referred to as a "no-flow strategy". When the, thermostat 19 is closed coolant provided by the coolant pump 17 flows directly into the outlet-side cylinder head coolant jacket 26. Specifically, the coolant may be directed into the coolant passages 16 adjacent to the exhaust-gas collector 11. Heat may be transferred from the exhaust-gas collector 11 to the coolant passages 16. The heated coolant may flow from the outlet-side cylinder head coolant jacket 26 into a cabin heating arrangement line 31. The cabin heating arrangement line 31 is fluidly coupled to a cabin heating arrangement 23. The cabin heating arrangement may be configured to transfer heat from the coolant fluid to a cabin in a vehicle. After the coolant is directed through the cabin heating arrangement the fluid is directed back to the coolant pump 17 via a coolant line 50. As shown in FIG. 2, the inlet-side cylinder head coolant jacket 15 may be fluidly coupled to the cabin heating arrangement line 31.

One advantage of the internal combustion engine 1, includes the ability of the engine to transfer heat from the integrated exhaust-gas collector 11 to the outlet-side cylinder head coolant jacket 26 and then flow the heated coolant from the outlet-side cylinder heat coolant jacket 26 to the cabin heating arrangement while substantially inhibiting coolant flow to the cylinder block coolant jacket 14. In this way, heat may be provided to the cabin during warm-up while the engine block is brought up to a desired operating temperature more quickly during engine warm-up. In other words a "no flow" strategy may be implemented while at the same time providing cabin heating.

As previously discussed, the cylinder block coolant jacket 14 may be fluidly connected via bores 20 in the cylinder head seal 21 to the inlet-side cylinder head coolant jacket 15, as shown in FIG. 2. It will be appreciated that the thermostat 19 controls the amount of coolant flowing into the cylinder block coolant jacket 14 and therefore through the bores 20 to the inlet-side cylinder head coolant jacket 15. In other words, flow to the cylinder block coolant jacket 14 and therefore inlet-side cylinder head coolant jacket 15 may be selectively inhibited based on operating conditions within the internal combustion engine 10. The internal combustion engine 1 may further include an outlet housing 36 shown in FIG. 4, discussed in greater detail herein.

Figure 4:
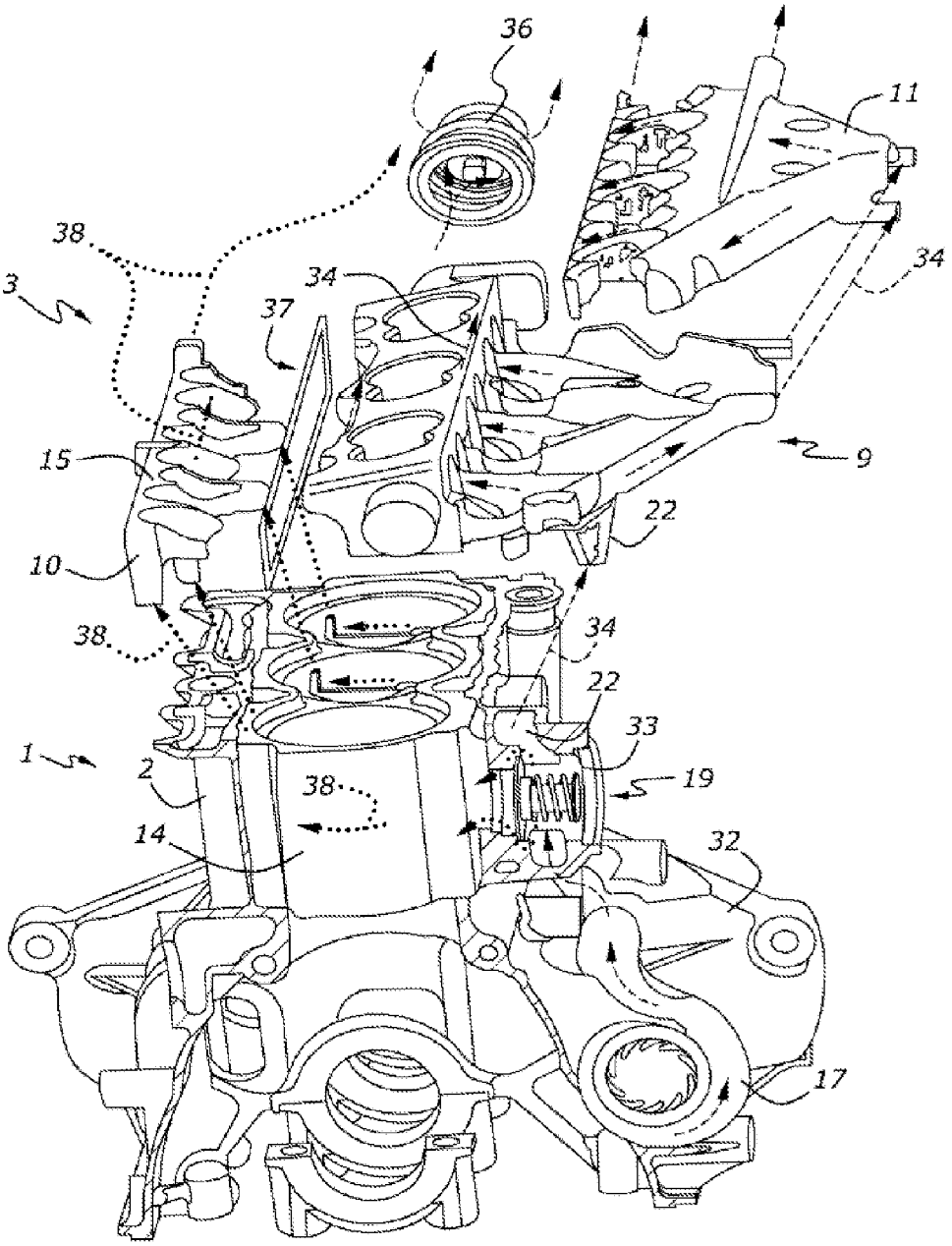
FIG. 4 shows an illustration of the internal combustion engine shown in FIG. 1, drawn approximately to scale.

In the exemplary example shown in FIG. 4, an exemplary cooling strategy is illustrated in a perspective view by way of an example engine 1. Although the engine is depicted as having 3 cylinders it will be appreciated that an alternate number of cylinders may be used in other examples.

As shown in FIG. 4, the coolant pump 17 is held in or covered by the covering hood (front cover) 32. The coolant pump 17 may be configured to provide coolant to the thermostat 19, which is held for example in a thermostat housing 33. The thermostat 19 may be configured to alter the coolant flow in a coolant branch of the cylinder block coolant jacket 14. It will be appreciated that coolant flow from the coolant pump 17 through the bypass 22 may be traversed by coolant while the engine 1 is in operation. As shown in FIG. 4, the thermostat 19 is arranged between a pump outlet and a cylinder block coolant jacket inlet, and is preferably integrated with its housing 33 into the cylinder block 2.

As previously discussed the thermostat 19 may be configured to adjust the amount of coolant flowing into the cylinder block coolant jacket 14 based on a temperature of the coolant. In particular, the thermostat may inhibit coolant flow to the cylinder block coolant jacket when the coolant is below a threshold temperature and permit flow to the cylinder block coolant jacket when the coolant is above the threshold temperature. The threshold temperature may be selected based on the desired engine operating conditions.

Specifically in one example, during at least a portion of a warm-up phase, the thermostat 19 may be configured to shuts off coolant flow to the cylinder block coolant jacket 14. In this way a "no flow" strategy may be implemented. It will be appreciated that a small quantity of coolant may leak through the thermostat 19 into the cylinder block coolant jacket when the flow is shut-off.

The bypass 22 which may be guided through the cylinder block 2, the cylinder head seal 21, and the cylinder head 3 into the outlet-side cylinder head coolant jacket 26 may be configured to flow coolant therethrough during engine operation. That is to say that the thermostat 19 may not control the coolant flow into the cylinder head coolant jacket. The coolant flow, denoted via arrows 34, through the exhaust-gas collector 11 integrated in the cylinder head 3 (e.g., the upper shell and/or lower shell) and through the outlet side 9 of the cylinder head 3 thus passes for example into an outlet housing 36 which may be connected to the cabin heating arrangement line 31. Said outlet housing may be coupled to or integrated within the cylinder head 3. The outlet housing 36 may include a plurality of components. Firstly, said outlet housing may be configured to receive coolant flow from the inlet-side cylinder head coolant jacket 15 and/or the outlet-side cylinder head coolant jacket 26. Furthermore, a venting line to a coolant compensating tank may be connected to the outlet housing. The outlet housing may further include connections to an oil heat exchanger, to the main cooler, and/or to the coolant pump inlet. Furthermore, a temperature sensor may be included in the outlet housing.

As shown in FIG. 4, the cylinder head 3 includes the inlet-side coolant jacket 15 in addition to the outlet-side cylinder head coolant jacket 26. By way of example, the inlet-side cylinder head coolant jacket 15 is separated from the outlet-side cylinder head coolant jacket 26 or the outlet side 9 by means of a partition 37.

As previously discussed, in a "no flow" coolant control strategy may be implemented in the internal combustion engine 1 during certain operating conditions, such as during a portion of a warm-up phase. Specifically, the "no flow" coolant control strategy may include inhibiting coolant from flowing through the cylinder block coolant jacket 14 during at least a portion of a warm-up phase. Additionally, in the "no flow" coolant control strategy coolant may be provided to the outlet-side cylinder head coolant jacket 26 during at least a portion of the warm-up phase. In other words, the outlet-side cylinder head coolant jacket 26 may be traversed by coolant during the warm-up phase. The outlet-side cylinder head coolant jacket may provide coolant to a cabin heating arrangement during at least a portion of the warm-up phase. In this way, heated coolant may be provided to the cabin heating arrangement while coolant flow to the cylinder block coolant jacket is inhibited. It will be appreciated that the "no flow" coolant control strategy may be discontinued when the cylinder block 2 reaches or surpasses a threshold temperature which may be predetermined.

Additionally, when the warm-up phase or at least a partial phase of the warm-up phase has been concluded and "no flow" coolant control strategy has been discontinued coolant flow through the thermostat 19 into the cylinder block coolant jacket 14 and through corresponding bores into the inlet-side cylinder head coolant jacket 15 of the cylinder head 3 may be permitted. Coolant may flow from the inlet-side cylinder head coolant jacket into the outlet housing 36 and mixes with the outlet-side coolant flow. This is illustrated by means of the arrows 38. However, the outlet housing 36 may not be included in the internal combustion engine 1 in some examples. In such an example mixing may take place in the cabin heating arrangement line 31, shown in FIG. 2.

Thus, according to the system of FIGS. 1-4, it is sought to maintain the prevention of the coolant flow through the cylinder block coolant jacket (the so-called "no-flow strategy"

for the cylinder block coolant jacket) for as long as possible in order to reduce friction losses during the warm-up phase. By discharging the hot gases or hot vapor (these naturally collect on an upper region), the no-flow strategy for the cylinder block coolant jacket can be maintained for longer, because said regions in which hot vapors otherwise accumulate can be traversed by coolant, such that thermal damage in said region is advantageously prevented.

The system of FIGS. 1-4 provides for improving an internal combustion engine of the type specified in the introduction using simple means, in which internal combustion engine an adequate heat flow is sought for a cabin heating arrangement, for example, despite the no-flow strategy for the cylinder block coolant jacket.

According to the system, an internal combustion engine having an exhaust-gas collector, preferably an exhaust-gas collector or exhaust manifold integrated in the cylinder head, has a cooling circuit which is separate from the cylinder block coolant jacket and which is connected to a common pump. The description further provides for the no-flow strategy of the cylinder block coolant jacket to be maintained for as long as possible, in particular after a cold start of the internal combustion engine, because the exhaust-gas collector is in effect provided with an external coolant circuit which is separate from the actual engine cooling circuit. It is thus possible for the heat of the exhaust gases in the exhaust-gas collector to be absorbed by the coolant circulating in the coolant circuit, and to be supplied for example to a cabin heating arrangement, without the need to discontinue the no-flow strategy of the cylinder block coolant jacket, wherein a faster warm-up of friction surfaces and of operating media, such as for example of lubricating oil, is advantageously attained.

In one example, it is preferably provided that the exhaust-gas collector is integrated in the cylinder head, that is to say formed in one piece with the latter. Here, the exhaust lines of each cylinder (a four-cylinder engine usually also has one exhaust line for each cylinder) merge in the exhaust-gas collector and a common exhaust line opens out, which common exhaust line leads to the exhaust section in which exhaust-gas aftertreatment devices, such as for example a catalytic converter, are arranged. The effective surface area is thus reduced, as a result of which it is possible for the exemplary catalytic converter to be brought up to its operating temperature more quickly.

Within the context of the description, it is expedient for the exhaust-gas collector or the coolant jacket thereof to be connected via a bypass to the common pump. The coolant circuit of the exhaust-gas collector also has, in addition to the bypass, a connecting line from the coolant jacket of the exhaust-gas collector for example to a cabin heating arrangement, and a return line which leads from the latter to the pump.

The bypass may be formed in the internal combustion engine and extend from the pump both through the engine block and through the cylinder head in the direction of the coolant jacket of the exhaust-gas collector. In this respect, the bypass may advantageously be formed either as a duct which is cast into the components or as a drilled duct, that is to say as a coolant duct. In a preferred example, the bypass is integrated in the cylinder block as a coolant duct between the coolant pump and the cylinder head. In a further preferred example, the bypass, or the corresponding coolant ducts, is/are guided in the front cover, in the cylinder block, through the cylinder head seal and into the (outlet-side) cylinder head, with the exhaust-gas collector being integrated in the cylinder head (at the outlet side).

An example is also conceivable in which the bypass is formed outside the internal combustion engine as an external line which is connected to the coolant jacket of the exhaust-gas collector. It is self-evidently also possible for a separate pump to be provided which generates the coolant flow through the exhaust-gas collector to the cabin heating arrangement and back to the (separate) pump. It is possible to activate the separate coolant pump only for the duration of the warm-up phase or a partial phase of the warm-up phase. The (separate) pump may also act so as to assist the main coolant pump.

The description thus serves to provide an exhaust-gas collector or exhaust manifold which is integrated in the cylinder head and which has a separate coolant jacket which, at least in the warm-up phase of the internal combustion engine, is not in contact with the cylinder block coolant jacket. In particular, the description makes it possible to maintain the "no-flow strategy" of the cylinder block coolant jacket for a particularly long time, even if there is a demand from vehicle occupants for cabin heating, for example. This is because, by means of the (additional) introduction of heat into the coolant from the exhaust gases, it is possible in this way for the cabin heating arrangement to perform its function without placing a load on the actual cooling circuit of the cylinder block coolant jacket. The cylinder head may self-evidently have on its inlet side a coolant circuit which is separate (split cooling) from its outlet side (on which the integrated exhaust-gas collector is arranged). Said inlet-side coolant jacket of the cylinder head is self-evidently also not in contact with the coolant jacket of the exhaust-gas collector. Here, it is also expedient that the cylinder block coolant jacket is connected via corresponding devices to the inlet-side cylinder head coolant jacket, such that the coolant vapors formed during the ZERO flow of the coolant in the cylinder block coolant jacket (no-flow strategy) can be discharged into the inlet-side cylinder head coolant jacket through bores or gas venting bores in the cylinder head seal. Within the context of the description, the no-flow strategy is restricted only to the cylinder block coolant jacket. This means that only a coolant flow in the cylinder block coolant jacket is virtually completely prevented (with the exception of small leakage quantities), whereas in the cylinder head, in particular in the outlet-side coolant jacket thereof, coolant flows permanently even in the warm-up phase, in particular in a first warm-up phase.

When the warm-up phase of the internal combustion engine has ended, the separate cooling circuit of the exhaust-gas collector can be connected up to the inlet-side cylinder head coolant jacket and the cylinder block coolant jacket.

With the description, it is thus also possible to provide a cooling strategy for an internal combustion engine, and a method for coolant control during the warm-up phase or during a first partial phase of the warm-up phase of the internal combustion engine, in which a coolant flow from a pump which is common to the cylinder block coolant jacket is guided, bypassing the cylinder block coolant jacket and so as not to be in contact with the latter in the warm-up phase, through a separate bypass to the exhaust-gas collector. By this advantageous approach, a permanent coolant flow is obtained in the outlet side of the cylinder head or in the outlet-side coolant jacket, while in the cylinder block coolant jacket the no-flow strategy can be maintained by closing the cylinder block thermostat, even if a vehicle occupant demands cabin heating, for example.

It may be expedient for the thermostat to be arranged between a coolant pump outlet and the cylinder block coolant jacket inlet. It can thus advantageously be ensured that the coolant has a ZERO flow (with the exception of small leakage quantities) in the cylinder block coolant jacket. In a preferred embodiment, the thermostat is integrated in the cylinder block. It may also be expedient for the thermostat to be arranged so as to be controlled by means of the temperature of the coolant in the cylinder block coolant jacket.

Figure 5:
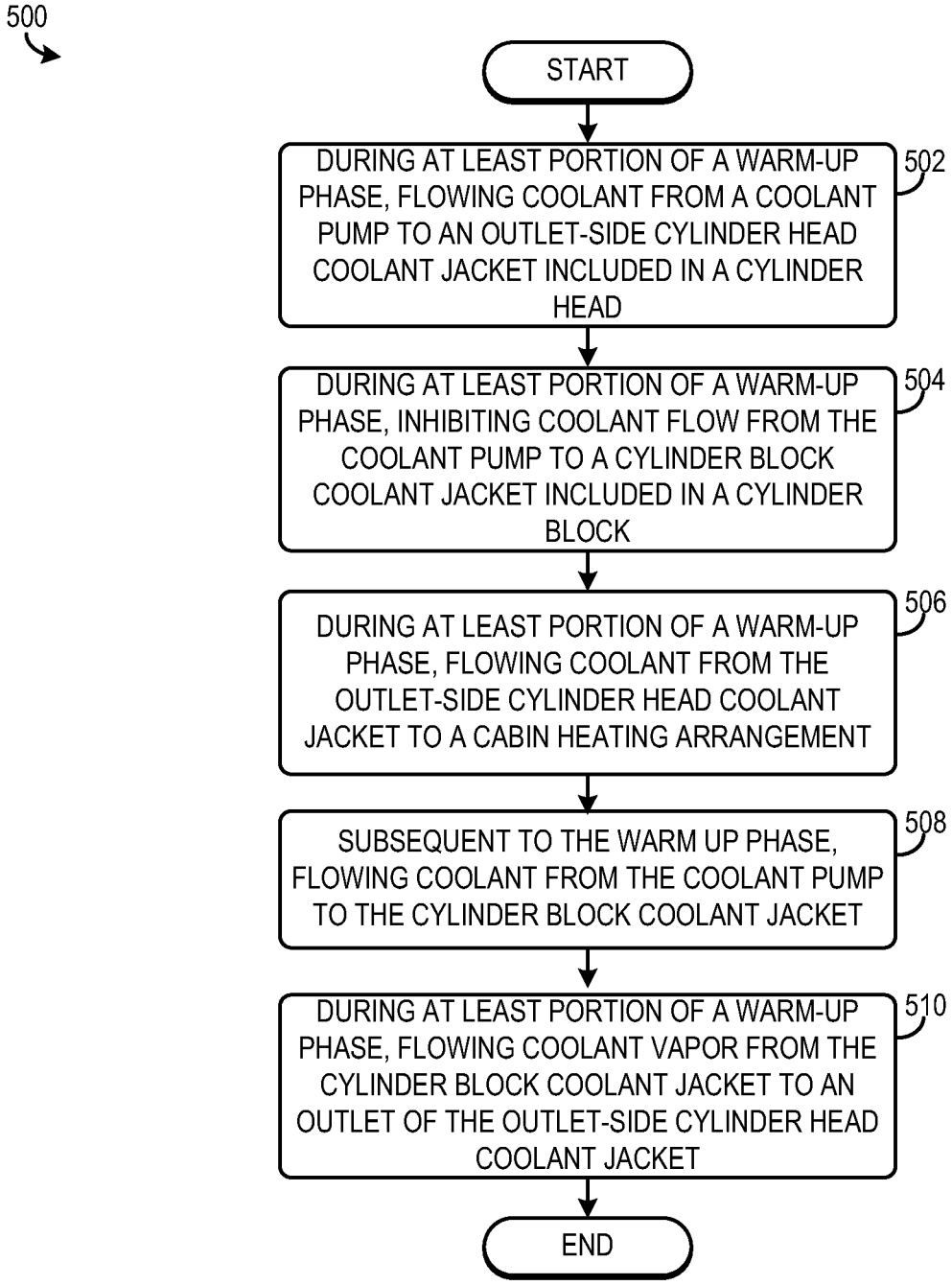
FIG. 5 shows a method for controlling coolant flow in an internal combustion engine.

FIG. 5 shows a method 500 for controlling coolant flow in an internal combustion engine. Method 500 may be implemented by the engines, systems, components, etc., described above in some examples. However in other examples other suitable engines, systems, components, etc., may be used to implement method 500.

At 502 the method includes during at least portion of a warm-up phase, flowing coolant from a coolant pump solely to an outlet-side cylinder head coolant jacket. In some examples flowing coolant from the coolant pump to an outlet-side cylinder head coolant jacket may be sustained during the entire duration of the warm-up phase. During the warm-up phase, flow from the pump to the engine block is substantially inhibited. At 504, method 500 includes, during at least portion of a warm-up phase, inhibiting coolant flow from the coolant pump to a cylinder block coolant jacket. At 506, the method includes during at least portion of a warm-up phase, flowing coolant from the outlet-side cylinder head coolant jacket to a cabin heating arrangement.

At 508, the method includes subsequent to the warm-up phase, flowing coolant from the coolant pump to the cylinder block coolant jacket. In this way, when the warm-up phase of the internal combustion engine has ended the inlet-side cylinder head coolant jacket and the cylinder block coolant jacket may be fluidly coupled to an the outlet-side cylinder head coolant jacket. At 510, the method includes flowing coolant vapor from the cylinder block coolant jacket to an outlet of the outlet-side cylinder head coolant jacket. After 510, the method ends.

Figure 6:
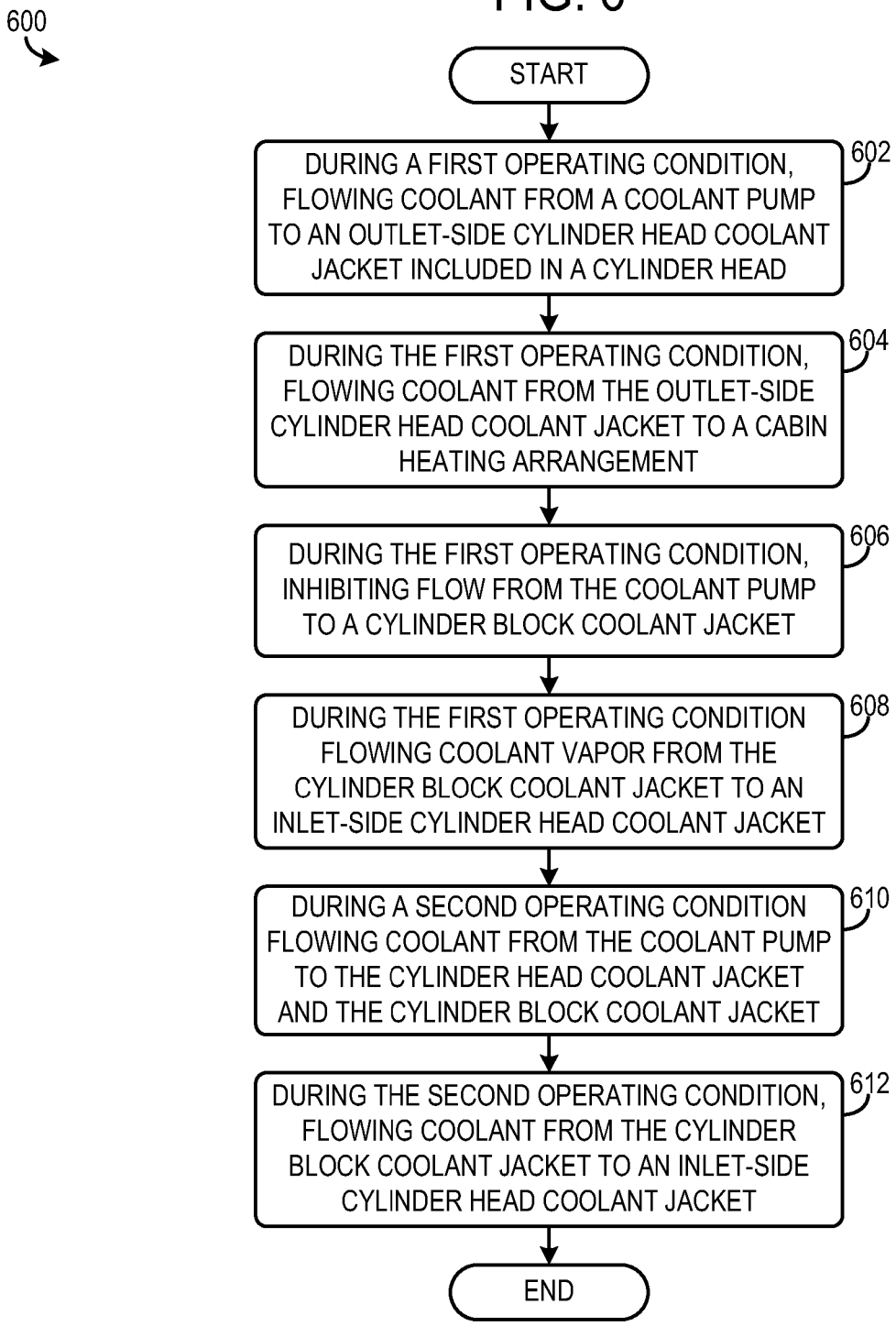
FIG. 6 shows a method for operation of an internal combustion engine.

FIG. 6 shows another method for operating internal combustion engine. Method 600 may be implemented by the engines, systems, components, etc., described above in some examples. However, in other examples, other suitable engines, systems, components, etc., may be used to implement method 600.

At 602, the method includes, during a first operating condition, flowing coolant from a coolant pump to an outlet-side cylinder head coolant jacket included in a cylinder head. As previously discussed, the exhaust-gas collector may be integrated into the cylinder head of the internal combustion engine and the coolant may be directed around the exhaust-gas collector. Next at 604, the method includes during the first operating condition, flowing coolant from the outlet-side cylinder head coolant jacket to a cabin heating arrangement.

At 606, the method includes during the first operating condition, inhibiting flow from the coolant pump to a cylinder block coolant jacket while allowing coolant flow to the exhaust collector cooling circuit. Next at 608, the method includes during the first operating condition flowing coolant vapor from the cylinder block coolant jacket to an inlet-side cylinder head coolant jacket. At 610, the method includes during a second operating condition flowing coolant from the coolant pump to the cylinder head coolant jacket and the cylinder block coolant jacket. At 612, the method includes during the second operating condition, flowing coolant from the cylinder block coolant jacket to an inlet-side cylinder head coolant jacket. After 612, the method may end.

It will be appreciated that the configurations and/or approaches described herein are exemplary in nature, and that these specific examples or examples are not to be considered in a limiting sense, because numerous variations are possible. The subject matter of the present disclosure includes all novel and nonobvious combinations and subcombinations of the various features, functions, acts, and/or properties disclosed herein, as well as any and all equivalents thereof.

The invention claimed is:

1. An engine comprising:

a cylinder block having a coolant jacket and a bypass;

a cylinder head including exhaust and inlet cooling circuits, the exhaust cooling circuit in fluidic communication with the bypass and isolated from the inlet cooling circuit and the coolant jacket, and the inlet cooling circuit connected to the coolant jacket via bores in a cylinder head seal positioned between the cylinder block and the cylinder head;

a coolant pump configured to provide coolant to the inlet cooling circuit via the coolant jacket and to each of the cylinder block and the exhaust cooling circuit via the bypass; and a thermostat positioned in the cylinder block and arranged between the coolant pump and the coolant jacket, the coolant jacket extending downstream of the thermostat to the bores in the cylinder head to connect to the inlet cooling circuit, and the bypass extending upstream of the thermostat to connect to the exhaust cooling circuit through one or more different bores in the cylinder head seal.

2. The engine of claim 1, where the cylinder head includes an integrated exhaust-gas collector providing a confluence point for exhaust of at least two engine cylinders, and where an inlet of the exhaust cooling circuit is selectively coupled to an inlet of the inlet cooling circuit via the thermostat.

3. The engine of claim 2, where the exhaust cooling circuit is configured to cool the integrated exhaust-gas collector.

4. The engine of claim 1, where the coolant jacket is a cylinder block coolant jacket, and where the bypass is configured to flow coolant through the cylinder block and around the cylinder block coolant jacket.

5. The engine of claim 4, further comprising a control system, the control system including instructions for, during a portion of a warm-up phase, flowing coolant through the inlet cooling circuit and inhibiting coolant flow through the cylinder block coolant jacket.

6. The engine of claim 5, where the inlet cooling circuit is in fluidic communication with a cabin heating arrangement, and where the control system includes further instructions for, during a portion of an engine warm-up phase, flowing coolant from the inlet cooling circuit to the cabin heating arrangement.

7. The engine of claim 6, an inlet-side cylinder head coolant jacket being in fluidic communication with the cabin heating arrangement.

8. The engine of claim 1, where the coolant jacket is a cylinder block coolant jacket, and coolant flow from the coolant pump to the coolant jacket and then to the inlet cooling circuit in the cylinder head flows in parallel to coolant flow from the coolant pump to the exhaust cooling circuit in the cylinder head.

9. The engine of claim 8, wherein the thermostat is integrated into the cylinder block.

10. The engine of claim 8, wherein the thermostat is configured to adjust an amount of coolant flow into the cylinder block coolant jacket based on a coolant temperature.

11. A method for controlling coolant in an engine, comprising:

during at least a portion of an engine warm-up phase, flowing coolant from a coolant pump to an exhaust-side cylinder head coolant jacket of a cylinder head through a cylinder block, the exhaust-side cylinder head coolant jacket arranged upstream of a thermostat in the cylinder block and configured to cool an exhaust-gas collector integrated into the cylinder head;

during at least a portion of the engine warm-up phase, inhibiting coolant flow from the coolant pump to a cylinder block coolant jacket downstream of the thermostat; and flowing coolant from the coolant pump to the thermostat, then from the thermostat to the cylinder block coolant jacket, and then from the cylinder block coolant jacket to an inlet-side cylinder head coolant jacket.

12. The method of claim 11, where flowing coolant from the coolant pump to the exhaust-side cylinder head cooling jacket is sustained during a duration of the engine warm-up phase.

13. The method of claim 12, further comprising during at least a portion of the engine warm-up phase, flowing coolant from the exhaust-side cylinder head coolant jacket to a cabin heating arrangement.

14. The method of claim 12, further comprising flowing coolant from the coolant pump to the cylinder block coolant jacket after the engine warm-up phase.

15. A method for operating an internal combustion engine comprising:

during a first operating condition, flowing coolant from a coolant pump to an exhaust-side cylinder head coolant jacket included in a cylinder head upstream of a thermostat arranged in a cylinder block of the engine, flowing coolant from the exhaust-side cylinder head coolant jacket to a cabin heating arrangement, and inhibiting flow from the coolant pump to a cylinder block coolant jacket downstream of the thermostat, the exhaust-side cylinder head coolant jacket including at least one coolant passage adjacent to an exhaust-gas collector; and during a second operating condition, flowing coolant from the coolant pump to the exhaust-side cylinder head coolant jacket upstream of the thermostat and the cylinder block coolant jacket downstream of the thermostat, and flowing coolant from the cylinder block coolant jacket through bores of a cylinder head seal positioned between the cylinder head and the cylinder block to an inlet-side cylinder head coolant jacket.

16. The method of claim 15, further comprising during the first operating condition flowing coolant vapor from the cylinder block coolant jacket through bores of the cylinder head seal positioned between the cylinder head and the cylinder block to the inlet-side cylinder head coolant jacket.

17. The method of claim 16, wherein the exhaust-gas collector is integrated into the cylinder head.

* * * * *